US008766124B2

(12) United States Patent
Alvarez et al.

(10) Patent No.: US 8,766,124 B2
(45) Date of Patent: Jul. 1, 2014

(54) CONTAMINENT RESISTANT MEMBRANE IN A DOME SWITCH AND METHODS FOR MAKING THE SAME

(75) Inventors: Felix Alvarez, San Jose, CA (US); Teodor Dabov, Mountain View, CA (US); Emery Sanford, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 244 days.

(21) Appl. No.: 12/895,113

(22) Filed: Sep. 30, 2010

(65) Prior Publication Data

US 2012/0080301 A1 Apr. 5, 2012

(51) Int. Cl.
*H01H 13/70* (2006.01)

(52) U.S. Cl.
USPC ..... 200/512; 200/515

(58) Field of Classification Search
USPC ..... 200/292, 512–517
See application file for complete search history.

(56) References Cited

U.S. PATENT DOCUMENTS

| | | | | |
|---|---|---|---|---|
| 6,327,144 | B1 | 12/2001 | May | |
| 6,396,013 | B1 | 5/2002 | Kondo | |
| 8,178,808 | B2 * | 5/2012 | Strittmatter | 200/515 |
| 2007/0241940 | A1 | 10/2007 | Hsu et al. | |
| 2010/0213044 | A1 * | 8/2010 | Strittmatter et al. | 200/515 |

FOREIGN PATENT DOCUMENTS

| | | | |
|---|---|---|---|
| WO | 0189950 | A2 | 11/2001 |

* cited by examiner

*Primary Examiner* — Amy Cohen Johnson
*Assistant Examiner* — Marina Fishman
(74) *Attorney, Agent, or Firm* — Brownstein Hyatt Farber Shreck, LLP

(57) ABSTRACT

A dome switch can include a dome mounted to a circuit board and secured by a sheet constructed from a material that is impermeable to air. To allow air enclosed by a volume between the dome and the circuit board to be expelled when the dome is depressed, the sheet can include at least one venting hole through which air can flow to the environment of the switch. To prevent contaminants from accessing the volume between the dome and the circuit board through the at least one venting hole, the dome switch can include a membrane positioned over the venting hole. The membrane can be constructed from a material that is permeable to air, but impermeable to contaminants. In some cases, the membrane can be constructed from a mesh material.

20 Claims, 5 Drawing Sheets

CONTAMINENT RESISTANT MEMBRANE IN A DOME SWITCH AND METHODS FOR MAKING THE SAME

BACKGROUND OF THE INVENTION

Users can provide inputs to electronic devices using many different approaches. In some cases, an electronic device can include a dome switch, which can be actuated to provide a detectable input. The dome switch can be constructed by placing a conductive dome over a contact pad of a circuit board. When the dome is pressed, the dome can invert such that an inner surface of the dome contacts the contact pad. A volume of air enclosed between the dome and the circuit board may be expelled from the dome when the dome is depressed, for example through vents of the dome switch. The vents however, may also allow foreign contaminants or particles to enter the volume enclosed between the inner surface of the dome and the circuit board. The foreign contaminants or particles can adversely affect the operation of the dome switch by causing rust, oxidation, dendrite growth, or deposits of foreign substances.

SUMMARY OF THE INVENTION

A dome switch having a membrane that is impermeable to contaminants but permeable to air, and methods for constructing the same, are provided.

A dome switch can include a circuit board having a contact pad, and a dome mounted on the circuit board over the contact pad. An internal surface of the dome can be offset from the contact pad such that an electrical path exists between the dome and the contact pad when the dome is depressed and comes into contact with the contact pad. To secure the dome to the circuit board, an adhesive sheet can be disposed over the dome and the circuit board. The adhesive sheet can include at least one vent through which air enclosed in a volume between the dome and the circuit board can be expelled when the dome is depressed. To prevent contaminants from entering the volume between the dome and the circuit board through the vent, the dome switch can include a membrane covering the vent. The membrane can be constructed from a material that is permeable to air to allow the dome to vent, but impermeable to contaminants to prevent damage to the dome.

The membrane can be disposed in any one of a number of different configurations to prevent ingress of undesired material into the dome. In one approach, the membrane can be disposed between the sheet and the dome or circuit board. In another approach, the membrane can be disposed over the sheet, such that the sheet is between the membrane and the dome or circuit board. The dome switch can include any suitable number of membranes including, for example, a single membrane covering one or more vents. As another example, the dome switch can include several membranes each covering different vents, or combining to cover a single vent.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

A dome switch used in an electronic device can include a dome mounted on a circuit board and defining a volume between the dome and the circuit board. To expel air from the volume when the dome is depressed, the dome can include venting holes that provide a path for air between an environment and the volume. In some cases, the venting holes can be provided in a sheet placed over the dome and circuit board and used to secure the dome to the circuit board. A membrane can be placed over the venting holes of the sheet to prevent contaminants from entering the volume while allowing air to be expelled from the volume.

Figure 1A:
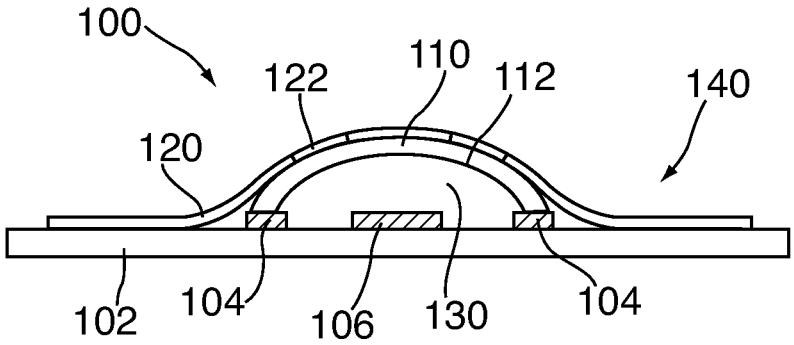
FIG. 1A is a cross-sectional view of an illustrative dome switch.
Figure 1B:
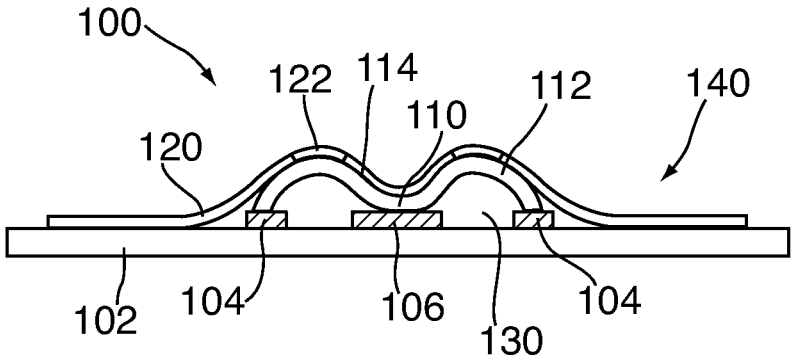
FIG. 1B is a cross-section view of the illustrative dome switch of FIG. 1A when the dome is depressed.

A dome switch can be constructed such that a dome is depressed to provide a detected signal to an electronic device. FIG. 1A is a cross-sectional view of an illustrative dome switch. FIG. 1B is a cross-sectional view of the illustrative dome switch of FIG. 1A when the dome is depressed. Dome switch 100 can include dome 110 mounted on circuit board 102. Circuit board 102 can include any suitable electrical component or circuit providing electrically conductive paths used for transferring signals. For example, circuit board 102 can include a printed circuit board or a flex circuit. Circuit board 102 can include outer contact pad 104 and inner contact pad 106 deposited on a surface of circuit board 102. Outer contact pad 104 and inner contact pad 106 can be electrically isolated so as to form a switch in an electrical circuit.

Dome 110 can be disposed on circuit board 102 to interface with outer contact pad 104 and inner contact pad 106. In some cases, dome 110 can be disposed such that a periphery of dome 110 is placed in electrical contact with outer contact pad 104. Dome 110 can include a conductive inner surface 112 such that when dome 110 is depressed, as shown in FIG. 1B, inner surface 112 provides a conductive path between outer contact pad 104 and inner contact pad 106, thus closing the switch formed by the contact pads.

Dome 110 can be constructed from any suitable material. For example, dome 110 can be constructed from a conductive material (e.g., sheet metal). As another example, dome 110 can be constructed from a non-conductive material, but can include a conductive coating applied to internal surface 112 (e.g., the surface of dome 110 that comes into contact with inner contact pad 106). Dome 110 can be constructed using any suitable approach including, for example, by stamping, machining, molding, or combinations of these.

Dome 110 can be secured to circuit board 102 using any suitable approach. In some cases, dome 110 can be coupled to circuit board 102 using a soldering or surface mount technology (SMT) process. Alternatively, a film or sheet 120 can be placed over dome 110 and adhered to circuit board 102 such that dome 110 is trapped between sheet 120 and circuit board 102. For example, sheet 120 can include a thin film of material on which an adhesive is placed. To properly secure dome 110 to circuit board 102, sheet 120 can extend beyond a periphery of dome 110, for example by at least an amount required to provide a hermetic seal between dome 110 and circuit board 102. This seal may be important, for example, to prevent debris or liquids from entering a volume 130 between circuit board 102 and dome 110.

Sheet 120 can be constructed from any suitable material. In some embodiments, sheet 120 can be constructed from a material that is impermeable to air such as, for example, a plastic (e.g., polypropylene, polystyrene, polyethylene, polyester, polyamides, polyurethane, polycarbonate, or polyethylene). By using a material that is impermeable to air, contaminants or other particles may not pass through sheet 120 to access volume 130 and damage dome switch 100.

When dome 110 is pressed and at least partially inverted, air enclosed in volume 130 between circuit board 102 and dome 110 may need to be expelled. If the air cannot be expelled when dome 110 is depressed, the size of volume 130 may diminish but the amount of air in volume 130 may remain the same. This may cause the air pressure within volume 130 to increase and resist the deformation of dome 110. Furthermore, if the air pressure increases in dome 130, dome switch 100 may not provide a desired tactile feedback (e.g., a tactile "click") to a user. Therefore, to allow air to escape from volume 130, sheet 120 can include vents 122 in the regions of the sheet that are adjacent to the dome. For example, vents 122 can be positioned entirely over the dome. As another example, vents 122 can be positioned around the interface between dome 110 and outer contact pad 104 (e.g., around the periphery of the dome).

Air initially enclosed within volume 130 can follow any suitable path to reach environment 140 outside of dome switch 100. In some cases, when dome 110 is depressed, the increased air pressure in volume 130 can cause dome 110 to be slightly raised from the surface of circuit board 102. When dome 110 rises, air can flow between dome 110 and circuit board 102 towards vents 122. In some cases, air may flow between outer surface 114 of dome 110 and sheet 120 to reach vents 122.

Alternatively, dome 110 or circuit board 102 can include openings, grooves, channels, or other paths for directing air from volume 130 towards vents 122.

Figure 2A:
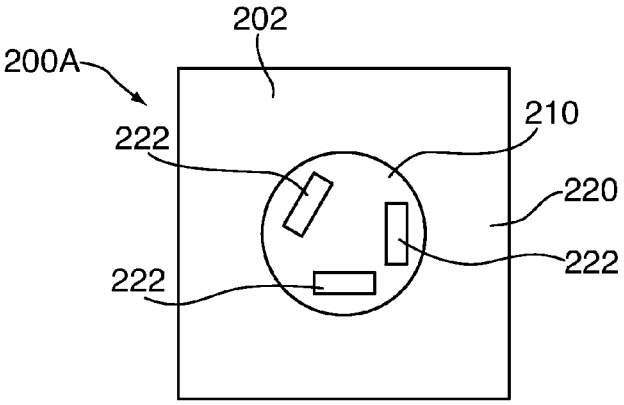
FIGS. 2A-2C are top views of illustrative dome switches having vents in accordance with some embodiments of the invention.
Figure 2B:
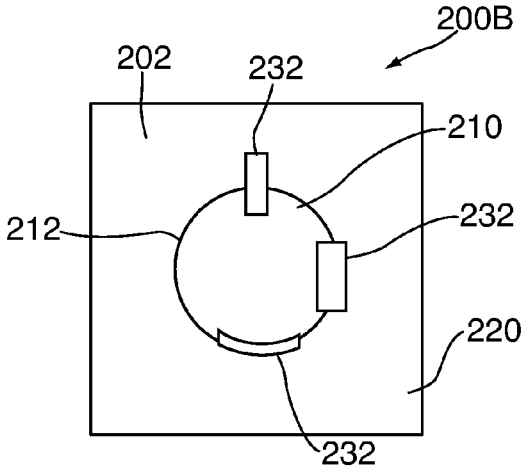
Figure 2C:
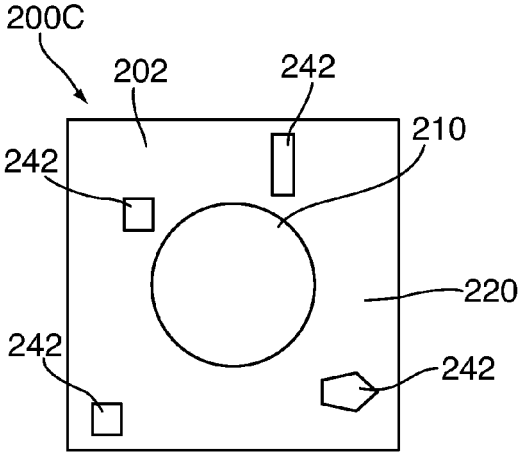

Vents 122 of dome switch 100 can include any suitable property for ensuring a proper venting of volume 130. FIGS. 2A-2C are top views of illustrative dome switches having vents in accordance with some embodiments of the invention. Dome switches 200A shown in FIG. 2A, 200B shown in FIG. 2B, and 200C shown in FIG. 2C, can include circuit board 202, dome 210 and sheet 220 having some or all of the features of the corresponding elements of dome switch 100 (FIGS. 1A and 1B). Dome switch 200A can include several vents 222 disposed in a portion of sheet 220 overlaid on dome 210. For example, dome switch 200A can include three distinct vents 222. The vents can cover any suitable area of dome 210 including, for example, an amount in the range of 15% to 50%, 20% to 40%, or 25% to 30%. Vents 222 can have any suitable shape including, for example, polygonal shape, circular or curved shape, or an arbitrary shape. The particular number, size and shape of the vents can be selected from an amount of air to expel from a volume underneath dome 210.

In some cases, one or more vents can be disposed adjacent to an interface between dome 210 and circuit board 202 (e.g., around periphery 212 of dome 210). Dome switch 200B, shown in FIG. 2B, can include vents 232 disposed at least partially over periphery 212. As discussed above in connection with dome switch 200A, dome switch 200B can include any suitable number of vents 232, and vents 232 can include any suitable size or shape, and can cover any suitable area of dome 210, sheet 220, or periphery 212.

In some cases, one or more vents can be disposed in a region of sheet 220 that does not overlap with dome 210. Dome switch 200C, shown in FIG. 2C, can include vents 242 disposed so as not to overlap with dome 210. As discussed above in connection with dome switch 200A, dome switch 200C can include any suitable number of vents 242, and vents 242 can include any suitable size or shape, and can cover any suitable area of sheet 220. Although FIGS. 2A-2C show vents disposed in different types of areas of sheet 220, it will be understood that a dome switch can include one or more vents disposed in any position on sheet 220.

In some cases, the size, shape, and/or number of vents used in a dome switch can be selected based on the position of a vent relative to the dome. For example, vents disposed closer to periphery 212 can be smaller than vents disposed away from periphery 212. As another example, a dome switch can include fewer vents disposed adjacent to periphery 212 than vents disposed away from periphery 212. This may be because air expelled from a volume underneath dome 210 can more rapidly reach a vent disposed adjacent to periphery 212, and may therefore be more quickly expelled from the volume than through a vent disposed farther away from the volume.

Because vents of a dome switch provide a path for expelling air from a volume underneath a dome, the vents can also provide a path for contaminants or other debris from an environment to reach the volume underneath the dome. Contaminants such as, for example, foreign particles, debris, liquid (e.g., sweat, water, juices, coffee, and soda), or other substances can cause mechanical and/or electrical disruptions or failure of the dome switch should they reach the inner contact pad or outer contact pad of the dome switch. For example, debris or liquid may cause dome switch 200 to short. As another example, contaminants can cause rust, oxidation, corrosion, dendrite growth, or salt, sugar or chemical deposits. To prevent the contaminants from reaching the volume underneath the dome, the vents may be obstructed.

Figure 3:
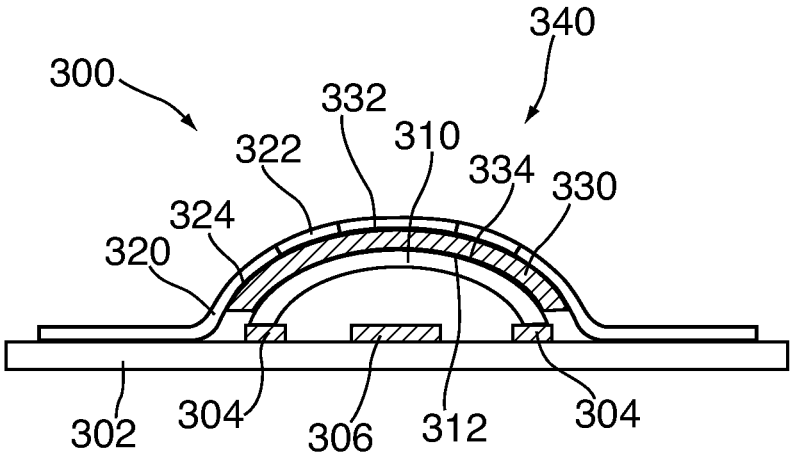
FIG. 3 is a cross-sectional view of a dome switch having a protective membrane in accordance with one embodiment of the invention.

A dome switch can include a membrane for preventing contaminants from reaching a volume underneath a dome. FIG. 3 is a sectional view of a dome switch having a protective membrane in accordance with one embodiment of the invention. Dome switch 300 can include circuit board 302 having outer contact pad 304 and inner contact pad 306, dome 310, and sheet 320 including vents 322. The various components of dome switch 300 can include some or all of the features of corresponding elements of dome switch 100 (FIGS. 1A-1B) or dome switches 200A, 200B and 200C (FIGS. 2A-2C). To prevent contaminants from passing through vents 322, dome switch 300 can include membrane 330 covering at least vents 322 of sheet 320.

Membrane 330 can be constructed from any suitable material. In particular, membrane 330 can be constructed from any material that allows air to pass through, but prevents contaminants from passing through. In some embodiments, membrane 330 can be constructed from a single layer or multilayer mesh material. The vents in the mesh can be selected such that air can pass through the mesh, but such that contaminants of a particular size cannot. The minimum mesh size can be selected based on any suitable criteria including, for example, the size of known contaminants, contaminants of a particular environment corresponding to where the dome switch will be used, contaminants from susceptible to damage the dome switch, or the size of any other contaminant. The particular material used for the membrane can include, for example, porous plastic (e.g., a porous polytetrafluoroethylene), Teflon, nylon, polyester, polyurethane, a composite material, organic material, synthetic material, or combinations of these.

In some cases, membrane 330 can include a treatment for improving the impermeability of the membrane to contaminants. For example, a hydrophobic or oleophobic treatment can be applied to the membrane. As another example, a surface treatment increasing the resistance of the membrane to abrasion or other forms of damage. The treatments can include, for example, the application of materials or substances to a surface of the membrane (e.g., surface treatments), or incorporating materials or substances within membrane 330 (e.g., between several layers or as part of a layer of membrane 330).

Membrane 330 can be secured to dome switch 300 using any suitable approach. In one implementation, membrane 330 can be coupled to one or both of sheet 320 and dome 310. For example, an adhesive layer can be placed between first surface 332 (e.g., an upper surface) of membrane 330 and second surface 324 (e.g., a bottom surface) of sheet 320 to secure the membrane to the sheet. When sheet 320 is placed over dome 310 and circuit board 302 to secure dome 310 to circuit board 302, membrane 330 can be retained between dome 310 and sheet 320. In some cases, additional adhesive can be placed between second surface 334 (e.g., a lower surface) of membrane 330 and first surface 312 (e.g., an upper or outer surface) of dome 312. This may prevent membrane 330 from moving relative to dome 310.

Membrane 330 can have any suitable position relative to sheet 320. In the example of dome switch 300, membrane 330 is positioned between sheet 320 and dome 310. Because membrane 330 may typically be smaller than sheet 320, this approach can ensure that a bond between membrane 330 and sheet 320 is protected from environment 340 by at least the thickness of sheet 320. In particular, this approach may reduce peeling of membrane 330 from sheet 320.

Figure 4:
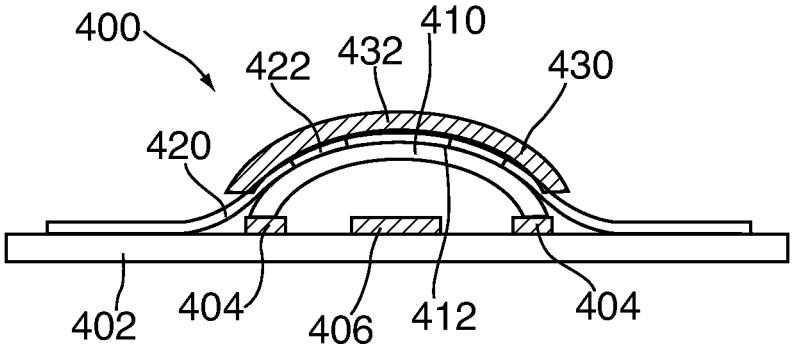
FIG. 4 is a cross-sectional view of another dome switch having a protective membrane in accordance with one embodiment of the invention.

FIG. 4 is a sectional view of another dome switch having a protective membrane in accordance with one embodiment of the invention. Dome switch 400 can include circuit board 402 having outer contact pad 404 and inner contact pad 406, dome 410, sheet 420 including vents 422, and membrane 430. The various components of dome switch 400 can include some or all of the features of corresponding elements of dome switch 300 (FIG. 3). Unlike dome switch 300, membrane 430 can be positioned such that sheet 420 is between dome 410 and membrane 430. In particular, first surface 432 (e.g., a lower or inner surface) of membrane 430 can be coupled to first surface 412 (e.g., an upper or outer surface) of sheet 420. This approach can ensure that sheet 420 can be coupled directly to the entire outer surface of dome 410, and can therefore enhance the bond between dome 410 and circuit board 402.

Figure 5A:
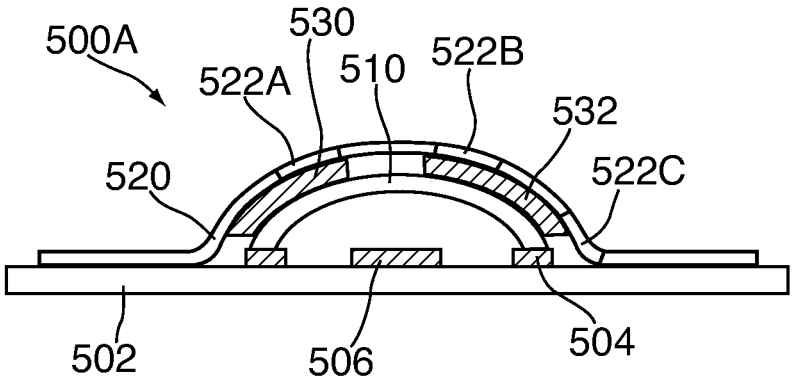
FIGS. 5A and 5B are cross-sectional views of an illustrative dome switches having several membranes in accordance with some embodiments of the invention.
Figure 5B:
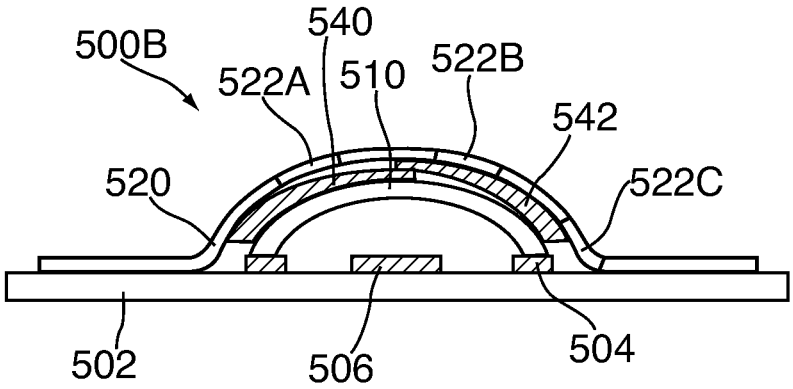

A dome switch can include any suitable number of membranes covering vents within a sheet. In some cases, a dome switch can include several distinct membranes. FIGS. 5A and 5B are cross-sectional views of illustrative dome switches having several membranes in accordance with some embodiments of the invention. Dome switches 500A and 500B can include circuit board 502, dome 510, sheet 520, and vents 522A, 522B and 522C in sheet 520 having some or all of the features of corresponding elements of the other dome switches described herein. In contrast with the dome switches described above, sheet 520 can include membranes 530 and 532 positioned at least partially over vents 522A, 522B and 522C in a manner that prevents the ingress of contaminants.

The several membranes of dome switch 500A can be disposed using any suitable approach. In one implementation, each membrane can be positioned over one or more distinct vents 522A, 522B and 522C. In the example shown in FIG. 5A, membrane 530 can be disposed over a single vent 522A, and membrane 532 can be disposed over vents 522B and 522C. Each of membranes 530 and 532 can be disposed over any suitable number of vents of sheet 520. For example, including, for example, a membrane such as membrane 532 can be disposed to overlap with a number of vents that ranges from one to the total number of vents in sheet 520.

In some cases, two or more membranes of a dome switch can be disposed so that they at least partially overlap. Dome switch 500B, shown in FIG. 5B, can include membranes 540 and 542 disposed such that membranes 540 and 542 overlap. In some cases, the overlapping portions of membranes 540 and 542 can cover a vent (e.g., vent 522B).

Membranes 540 and 542 can have any suitable thickness. In some cases, the overlapping portions of membranes 540 and 542 can have a reduced thickness selected such that the thickness of the overlapping portions of membranes 540 and 542 substantially match the thickness of one or both of the non-overlapping portions of membrane 540 and membrane 542. This approach may ensure that sheet 520 is coupled to a smooth surface that does not have height variations. In some cases, the thickness of a membrane can vary, for example with a tapered edge away from a vent and a thicker region over the vent to provide more substantial protection in regions through which contaminants attempt to pass. The membrane can have any suitable thickness including, for example, a thickness in the range of 1.0 mm to 0.05 mm (e.g., 0.5 mm).

Figure 6:
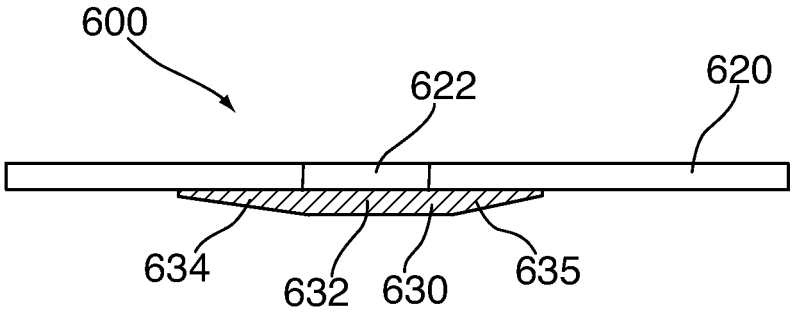
FIG. 6 is a cross-sectional view of an illustrative sheet and membrane for use with a dome switch in accordance with some embodiments of the invention.

In some cases, a membrane can be coupled to a sheet before the sheet and membrane are coupled to a circuit board and dome. FIG. 6 is a sectional view of an illustrative sub-assembly 600 including sheet 620 and membrane 630 for use with a dome switch in accordance with some embodiments of the invention. Sheet 620 can include vent 622 through which air can flow. To prevent contaminants from passing through vent 622, membrane 630 can be coupled to sheet 620 opposite the vent. In particular, membrane 630 can include central region 632 positioned opposite vent 622 and edge regions 634 and 635 extending around the periphery of vent 622. Edge regions 634 and 635 can have any suitable thickness including, for example, a variable and decreasing thickness (e.g., the thickness can vary between a zero or minimum value to a maximum value corresponding to region 632). In some embodiments, central region 632 can have a thickness at least equal to the largest thickness of one or both of edge regions 634 and 635.

An adhesive can be applied to a surface of one or both of sheet 620 and membrane 630 such that membrane 630 can be securely coupled to sheet 620. In some embodiments, one or both of the membrane and sheet can be constructed with an embedded adhesive layer (e.g., forming a tape) such that the membrane and sheet can be put in contact with one another to securely couple the components together. Assembled sheet and membrane component 600 can be placed over a dome in any suitable orientation. For example, component 600 can be disposed such that membrane 630 is placed in contact with a dome, and sheet 620 forms an outer surface of the dome switch. As another example, component 600 can be disposed such that sheet 620 is placed in contact with a dome, and membrane 630 forms an exposed outer surface of the dome switch.

Figure 7:
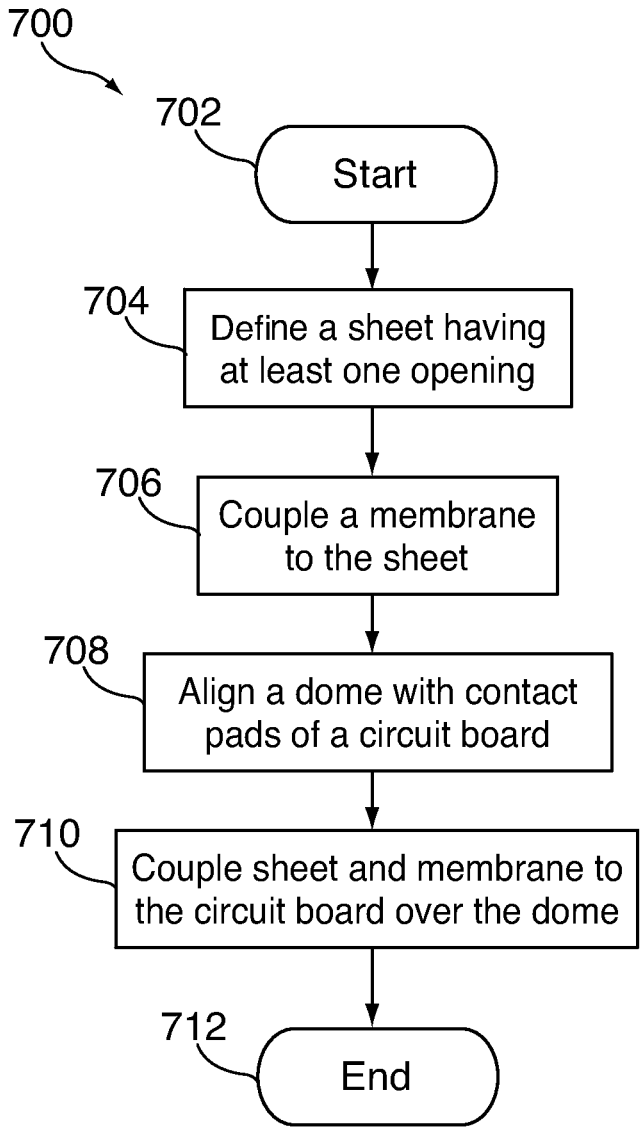
FIG. 7 is a flowchart of an illustrative process for assembling a dome switch in accordance with one embodiment of the invention.

FIG. 7 is a flowchart of an illustrative process for assembling a dome switch in accordance with one embodiment of the invention. Process 700 can begin at step 702. At step 704, a sheet can be defined, where the sheet can include at least one vent. For example, a sheet can be defined from a material that is impermeable to air, and in which at least one vent can be created (e.g., cut out). In some embodiments, the vent can be positioned on the sheet relative to an expected position of a dome. At step 706, a membrane can be coupled to the sheet. For example, a membrane can be placed over the sheet such that the membrane covers the vent of the sheet. In some embodiments, portions of the membrane can extend beyond a periphery of the vent to ensure that air can pass through the sheet only by passing through the membrane. The membrane can be selected from a material that is permeable to air but impermeable to contaminants. At step 708, a dome can be aligned with contact pads of a circuit board. For example, a periphery of a dome can be disposed over an outer contact pad such that an interior surface of the dome can come into contact with an inner contact pad when the dome is depressed. At step 710, the sheet and membrane can be coupled to the circuit board over the dome. For example, the sheet and membrane can be aligned with the circuit board and dome such that the vent is disposed at a desired position relative to the dome. In particular, the sheet and membrane can be positioned in the vicinity of the dome (e.g., in the vicinity of the periphery of dome) to ensure that air flowing a volume enclosed by the dome and a dome switch environment passes through the vent and the membrane. By coupling the sheet and the membrane to the circuit board over the dome, the dome can be securely retained in contact with the circuit board. Process 700 can then end at step 712.

It will be understood that the foregoing is only illustrative, and that various modifications can be made by those skilled in the art without departing from the scope and spirit of embodiments of the invention. For example, the shapes of various components shown in the drawings are only illustrative, and many of these components can have different shapes if desired. This is not limited to dome switches, but rather can apply to any of several types of switches.

What is claimed is:

1. A dome switch, comprising:

a circuit board comprising at least two contact pads;

a dome mounted on the circuit board, and a periphery of the dome being in electrical contact with one of the at least two contact pads;

a sheet attached to the dome and to the circuit board, a portion of the sheet covering the dome, wherein the portion of the sheet covering the dome includes a plurality of vents to vent air enclosed under the dome; and a membrane coupled to the sheet and positioned above the dome, wherein the membrane is substantially permeable to air and substantially impermeable to contaminants to at least one of inhibit or prevent contaminants from passing through the plurality of vents.

2. The dome switch of claim 1, wherein:

the plurality of vents of the sheet is positioned adjacent to the periphery of the dome.

3. The dome switch of claim 1, wherein:

the membrane is positioned between the sheet and the dome.

4. The dome switch of claim 3, wherein the membrane further comprises:

a central region covering the plurality of vents, wherein the central region has a first thickness; and an edge region adjacent to the central region, wherein the edge region has a second thickness.

5. The dome switch of claim 4, wherein:

the second thickness is variable.

6. The dome switch of claim 5, wherein:

the second thickness ranges between an amount equal to the first thickness and a smaller amount.

7. The dome switch of claim 1, wherein:

at least a portion of the sheet is positioned between the membrane and the dome.

8. The dome switch of claim 1, wherein:

the dome switch comprises at least two membranes; and one of the at least two membranes does not cover all of the plurality of vents.

9. The dome switch of claim 8, wherein:

the at least two membranes overlap over one of the plurality of vents.

10. A method for constructing a dome switch, comprising:

aligning a dome with a contact pad of a circuit board;

applying a sheet to the dome and circuit board, a portion of the sheet covering the dome, wherein the portion of the sheet covering the dome includes a plurality of vents, and wherein the sheet is formed from a material that is substantially impermeable to air;

applying a membrane to the sheet, wherein the membrane is formed from a material that is substantially permeable to air and substantially impermeable to contaminants, and wherein the membrane is positioned above the dome and over the plurality of vents formed in the sheet; and attaching the sheet and membrane to the circuit board over the dome to secure the dome to the circuit board such that a portion of the sheet comprising the plurality of vents is overlaid on the dome, wherein air within the dome vents through the membrane.

11. The method of claim 10, further comprising:

applying an adhesive to a surface of the sheet, wherein the adhesive is operative to couple at least one of the membrane, the dome and the circuit board with the surface of the sheet.

12. The method of claim 10, wherein:

the membrane is constructed from a mesh material, wherein openings in the mesh are smaller than the size of liquid vapor.

13. The method of claim 10, wherein the membrane is constructed from at least one of:

polytetrafluoroethylene;

Teflon;

nylon;

polyester; and polyurethane.

14. The method of claim 10, wherein:

a first surface of the membrane is coupled to a portion of the first surface of the sheet; and the circuit board is coupled to another portion of the first surface of the sheet.

15. The method of claim 14, further comprising:

applying an adhesive to a second surface of the membrane, wherein the second surface of the membrane is opposite the first surface of the membrane; and coupling at least a portion of the second surface of the membrane to an exterior surface of the dome.

16. The method of claim 10, wherein:

the membrane is coupled to a first surface of the sheet; and the circuit board is coupled to a second surface of the sheet, wherein the second surface of the sheet is opposite the first surface of the sheet.

17. The method of claim 10, wherein the sheet comprises two vents, and at least a portion of the membrane is positioned over the two vents.

18. A dome switch, comprising:

a dome placed on a contact pad, wherein the dome is operative to close an electrical circuit when the dome is at least partially inverted;

a sheet constructed from a material substantially impermeable to air, the sheet being secured to the dome to form an air tight seal around the dome, wherein a portion of the sheet overlaying the dome includes a plurality of vents providing a passage for air through the sheet; and a membrane coupled to the sheet and positioned between the sheet and the dome, wherein the membrane covers the entirety of the plurality of vents formed in the sheet, and wherein the membrane is substantially impermeable to contaminants.

19. The dome switch of claim 18, further comprising:

a circuit board comprising the contact pad, wherein the sheet is coupled to the circuit board.

20. The dome switch of claim 18, further comprising:

at least two membranes, wherein the at least two membranes overlap over at least one of the plurality of vents of the sheet.

* * * * *